US008201789B1

(12) United States Patent
Chou

(10) Patent No.: US 8,201,789 B1
(45) Date of Patent: Jun. 19, 2012

(54) BLIND SUPPORT FOR INSTALLATION OF A BLIND RAIL

(76) Inventor: Tser Wen Chou, Taipei (TW)

( * ) Notice: Subject to any disclaimer, the term of this patent is extended or adjusted under 35 U.S.C. 154(b) by 0 days.

(21) Appl. No.: 13/014,957

(22) Filed: Jan. 27, 2011

(51) Int. Cl.
*A47H 1/10* (2006.01)

(52) U.S. Cl. ... 248/262; 248/254; 248/251; 248/221.11; 160/902

(58) Field of Classification Search ..... 248/264, 248/262, 254, 251, 261, 265, 252, 221.11; 160/902, 903
See application file for complete search history.

(56) References Cited

U.S. PATENT DOCUMENTS 2,674,432 A * 4/1954 Lorentzen ..... 248/264
4,224,974 A * 9/1980 Anderson et al. ..... 160/178.1 R
4,235,406 A * 11/1980 Vecchiarelli ..... 248/251
4,580,753 A * 4/1986 Hennequin ..... 248/264
4,643,238 A * 2/1987 Tachikawa et al. .... 160/168.1 R
4,919,185 A * 4/1990 Comeau et al. ..... 160/178.1 R
5,180,130 A * 1/1993 McMichael ..... 248/251
6,382,295 B1 * 5/2002 Nicholson ..... 160/178.1 R
7,048,028 B2 * 5/2006 Wolfe et al. ..... 160/173 R
7,543,624 B2 * 6/2009 Rodriguez ..... 160/178.1 R

* cited by examiner

*Primary Examiner* — Anita M King
*Assistant Examiner* — Monica Millner
(74) *Attorney, Agent, or Firm* — Ming chow; Sinorica, LLC

(57) ABSTRACT

A blind support for installation of a blind rail. The blind support includes a main support body and an engagement member. The main support body has two horizontal support boards and a vertical support board connected between the horizontal support boards to form a support body with an open side. The blind rail can be placed into the main support body through the open side thereof and supported by the main support body. The engagement member has horizontally extending abutment sections that can be slidably received slide channels of the main support body. Each abutment section has a key body projecting therefrom. The key bodies are engageable in engagement holes formed on the main support body to block the open side thereof and enclose and support the blind rail.

2 Claims, 22 Drawing Sheets

BLIND SUPPORT FOR INSTALLATION OF A BLIND RAIL

BACKGROUND OF THE INVENTION

1. Field of the Invention

The present invention relates generally to blind components, and more particularly to a blind support for installation of a blind rail. The blind support can be quickly assembled/disassembled for installation/uninstallation of the blind rail. In addition, the blind support is able to securely fix and support the blind rail.

2. Description of the Related Art

A conventional blind rail support has hook sections in abutment with the blind rail. Such measure has a shortcoming that the blind rail support fails to securely support the blind rail. Another type of conventional blind rail support is composed of support boards for supporting the blind rail. Such structure is able to provide enhanced support effect for the blind rail. However, in installation, it is necessary to previously connect the support boards with the blind rail and then install the entire blind rail assembly. It is quite troublesome and inconvenient to install/uninstall the blind rail assembly, especially to uninstall the blind rail assembly.

SUMMARY OF THE INVENTION

It is therefore a primary object of the present invention to provide a blind support for installation of a blind rail. The blind support can be quickly assembled/disassembled for installation/uninstallation of the blind rail. In addition, the blind support is able to securely fix and support the blind rail. The blind support includes a main support body and an engagement member. The engagement member can be assembled with the main support body to form a support body for providing good fixing effect for the blind rail. The blind support of the present invention is free from the problem of unstability existing in the conventional blind rail support with hook sections. Also, in comparison with the prior art, the blind support of the present invention can be easily installed/uninstalled.

To achieve the above and other objects, the blind support of the present invention includes a main support body and an engagement member. The main support body has two horizontal support boards and a vertical support board connected between the horizontal support boards to form a support body with an open side. The upper and lower horizontal support boards are respectively formed with through holes for fastening screws to pass through. Slide channels are formed on the edges of the main support body. The engagement member has horizontally extending abutment sections that can be slidably received the slide channels of the main support body. Each abutment section has a key body projecting therefrom. The key bodies are engageable in engagement holes formed on the main support body to block the open side thereof and enclose and support the blind rail.

The present invention can be best understood through the following description and accompanying drawings, wherein:

DETAILED DESCRIPTION OF THE PREFERRED EMBODIMENTS

Figure 1:
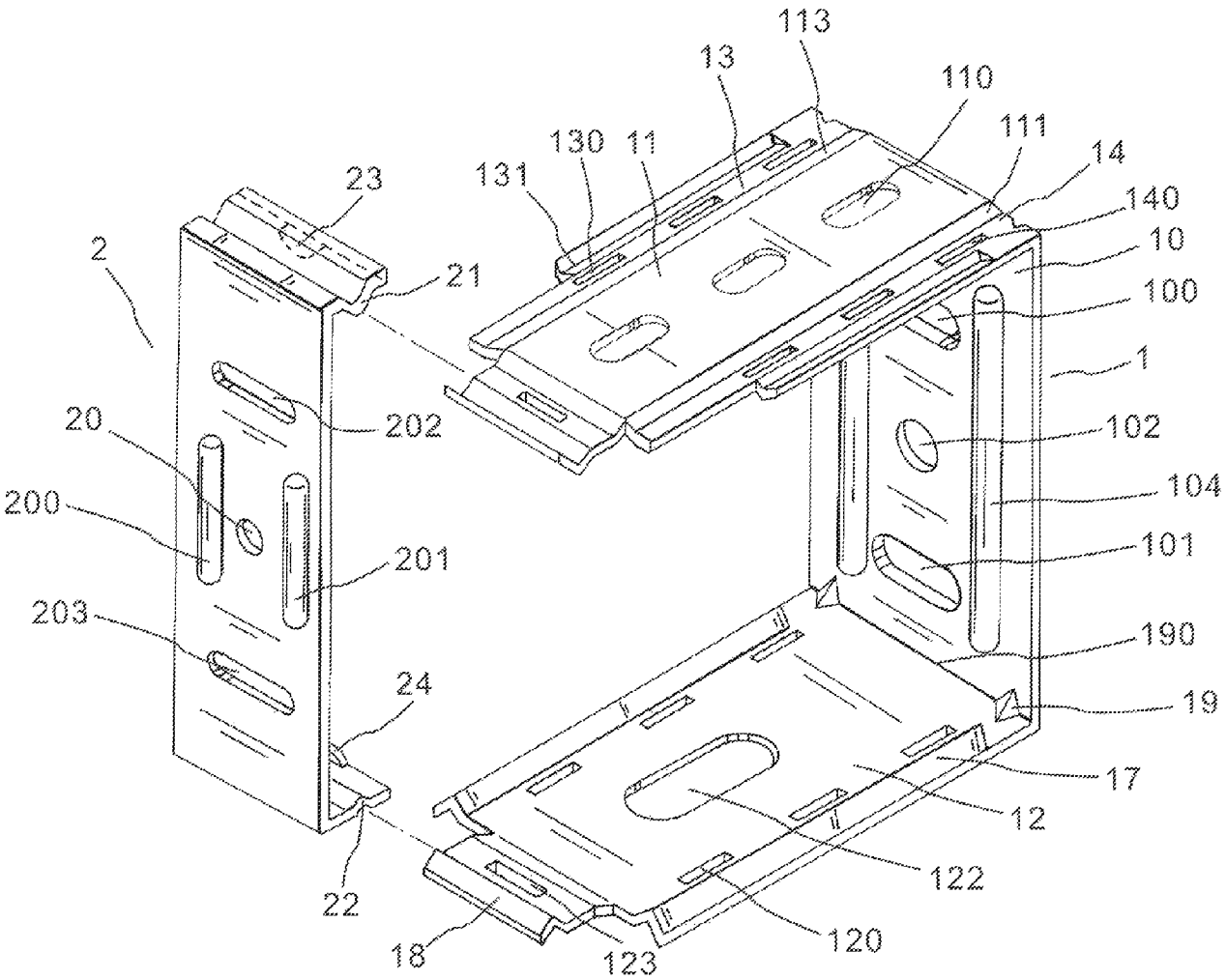
FIG. 1 is a perspective exploded view of the present invention.

Please refer to FIG. 1. The blind support of the present invention includes a main support body 1 and an engagement member 2. The main support body 1 has two horizontal support boards 11, 12 and a vertical support board 10 connected between the two horizontal support boards to form a support body with an open side. The vertical support board 10 is formed with two transverse through holes 100, 101 and a perforation 102 between the two transverse through holes 100, 101. In addition, the vertical support board 10 is formed with two vertical inward protruding reinforcement ribs 103, 104 on two sides of the transverse through holes 100, 101. The horizontal support board 11 horizontally extends from an upper end of the vertical support board 10. The horizontal support board 11 is formed with several slots 110 for screws to pass therethrough. The horizontal support board 11 has three free sides that are not connected with the vertical support board 10. Each free side has an oblique edge 111, 112, 113 obliquely extending from the free side. An engagement edge 13, 14, 15 further extends from the oblique edge 111, 112, 113 at a slightly lower height. The engagement edge 13, 14, 15 is formed with at least one engagement hole 130, 140, 150. As shown in the drawings, the engagement holes 130, 140, 150 are substantially slits. A slide channel 131, 141, 151 further extends from each engagement edge 13, 14, 15. Two lateral slide channels 131, 141 are spaced from the edge of the vertical support board 10 by a certain distance. The horizontal support board 12 horizontally extends from a lower end of the vertical support board 10. The horizontal support board 12 is formed with a larger slot 120 corresponding to the slots 110 of the upper horizontal support board 11. The horizontal support board 12 is further formed with several engagement holes 121, 122, 123 positioned on three free sides of the horizontal support board 12. Three slide channels 16, 17, 18 directly horizontally extend from the three free sides of the horizontal support board 12 respectively. Two lateral slide channels 16, 17 are also spaced from the edge of the vertical support board 10 by a certain distance. In addition, reinforcement blocks 19 are formed in the corners 190 between the horizontal support boards 11, 12 and the vertical support board 10.

The engagement member 2 is a vertical board body. The engagement member 2 is formed with two transverse through holes 202, 203 and a perforation 20 between the transverse through holes 202, 203. In addition, the engagement member 2 is formed with two vertical inward protruding reinforcement ribs 200, 201 on two sides of the perforation 20. Two abutment sections 21, 22 respectively forward extend from upper and lower edges of the engagement member 2. At least one key body 23, 24 projects from front end of each abutment section 21, 22. In a preferred embodiment, the key body 23, 24 is an arcuate body as shown in the drawings.

Figure 2:
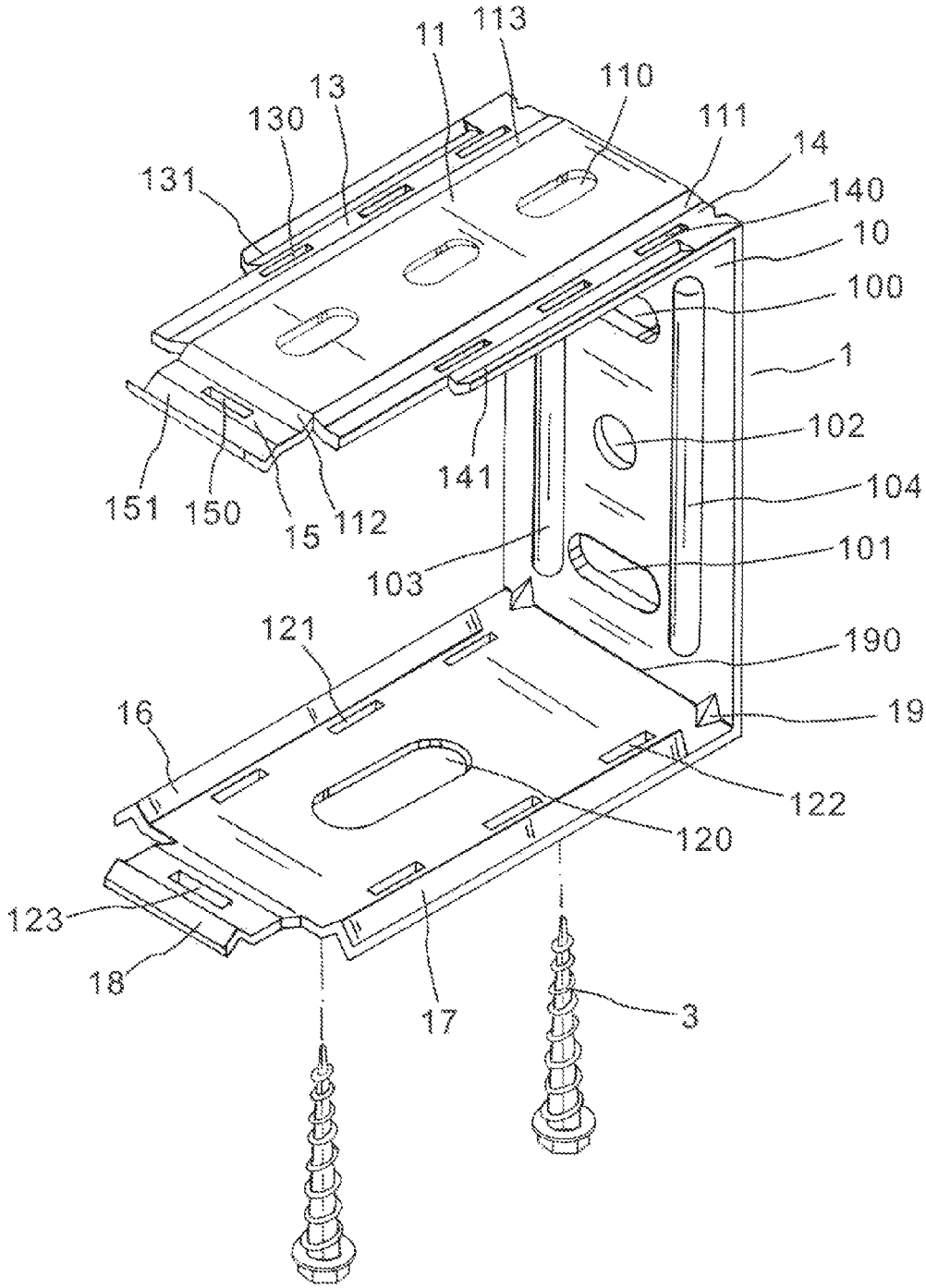
FIG. 2 is a perspective view showing that the present invention is fixed with screws.
Figure 3:
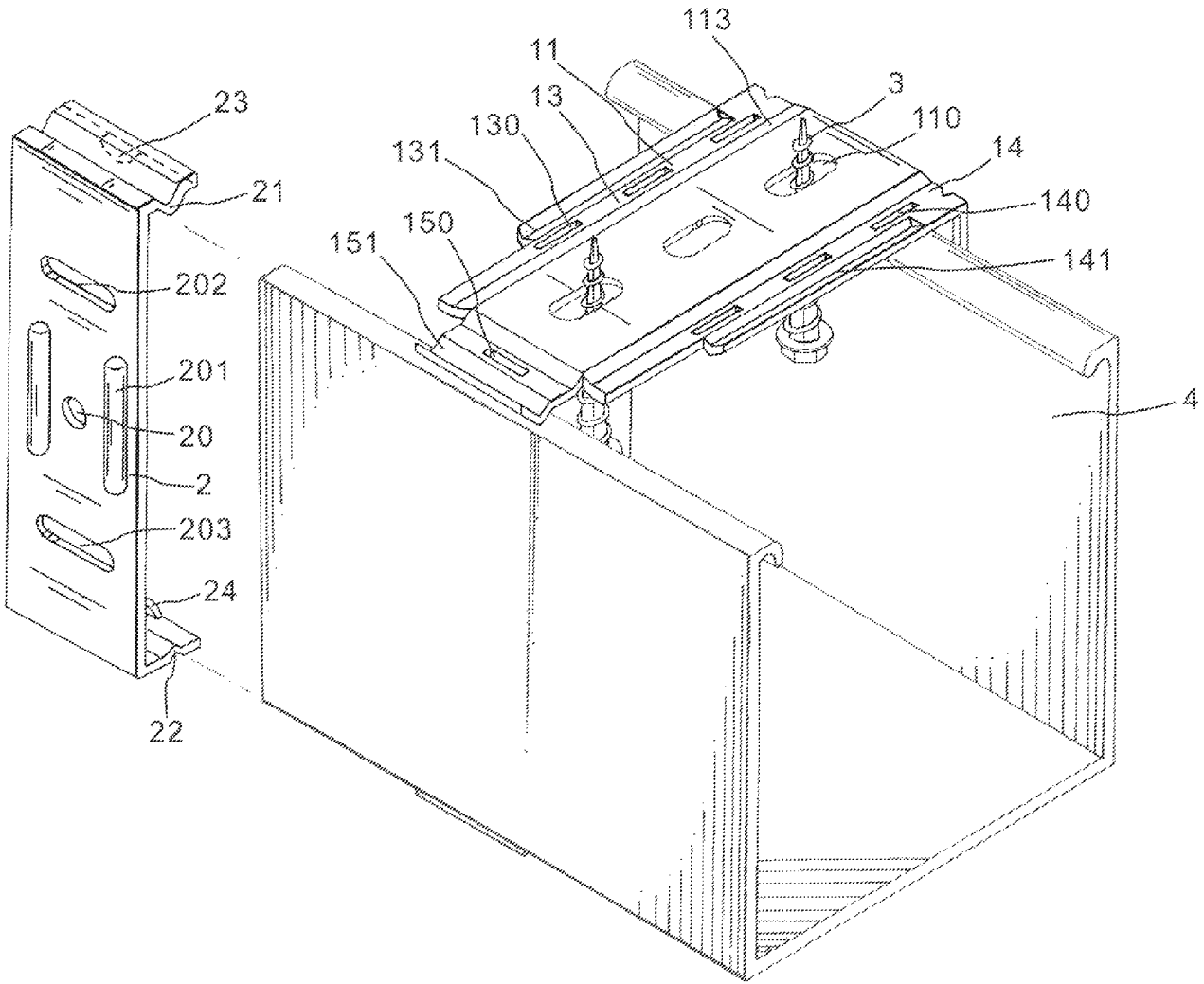
FIG. 3 is a perspective partially assembled view of the present invention.
Figure 4:
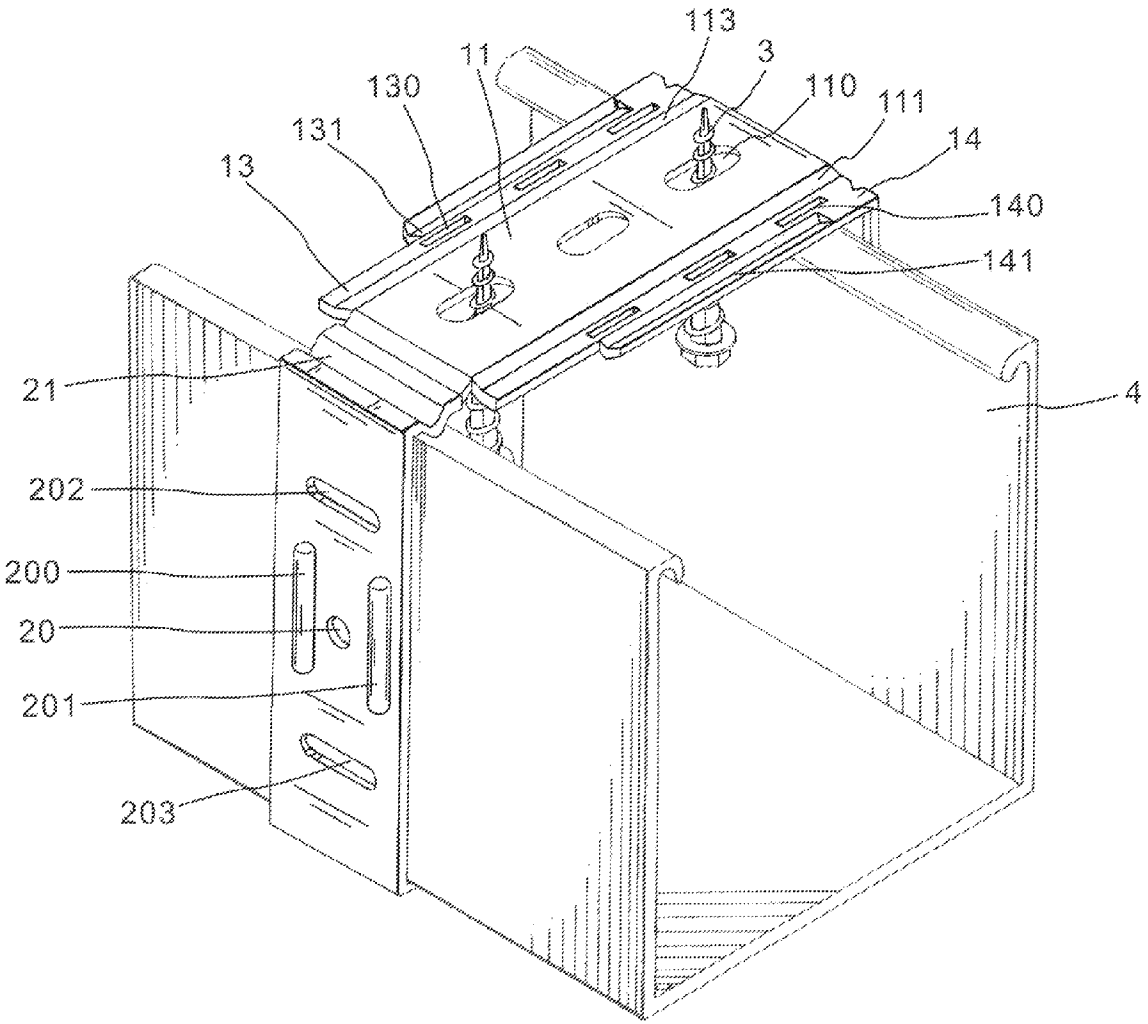
FIG. 4 is a perspective assembled view of the present invention.
Figure 5:
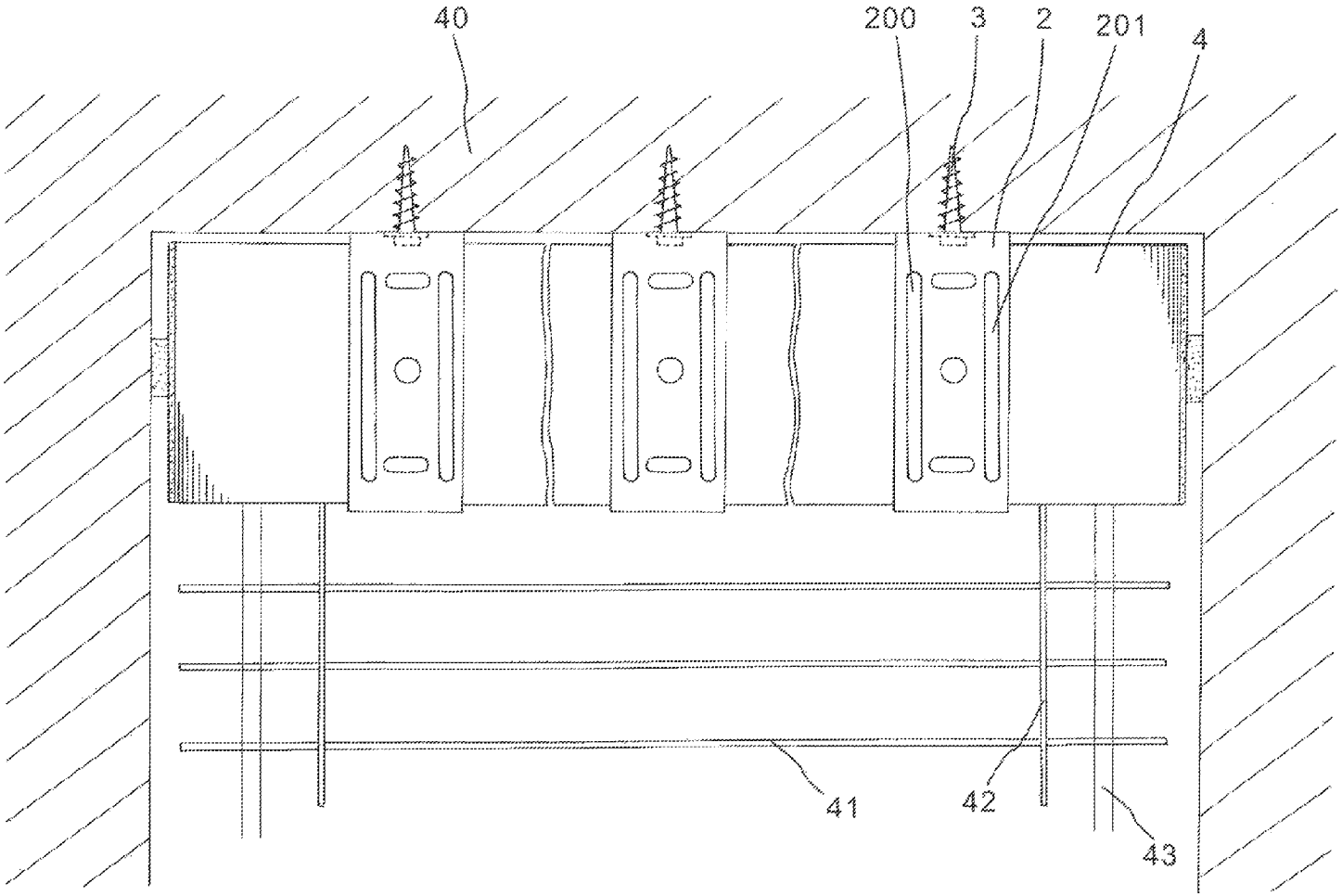
FIG. 5 is a plane view showing the installation of the present invention.

When installed, as shown in FIGS. 2 and 3, long screws 3 are passed through the slot 120 of the lower horizontal support board 12 and the through holes 110 of the upper horizontal support board 11 to previously affix the main support body 1 under a ceiling or on a wall face. A blind rail 4 is placed into the main support body 1 through the open side of the main support body 1. The vertical support board 10 and the horizontal support boards 11, 12 abut against the blind rail 4 to support the same. Then, the engagement member 2 is laterally inserted to make the abutment sections 21, 22 slidably received in the slide channels 151, 18. During sliding movement, the key bodies 23, 24 can be smoothly engaged into the engagement holes 150, 123 under the guide of the arcuate structure. Accordingly, the engagement member 2 can be fixedly connected with the main support body 1 to block the open side thereof. The inward protruding vertical reinforcement ribs 200, 201 of the engagement member 2 serve to abut against a front wall of the blind rail 4 (as shown in FIG. 4) to install the blind rail 4 on a wall face 40 above a window (as shown in FIG. 5). Then, the control components of the blind are arranged in the blind rail 4. The ladder string 42 downward extends to connect with the blind slats 41 for a control cord 43 to control opening/closing of the blind slats 41 (as shown in FIG. 6).

Figure 6:
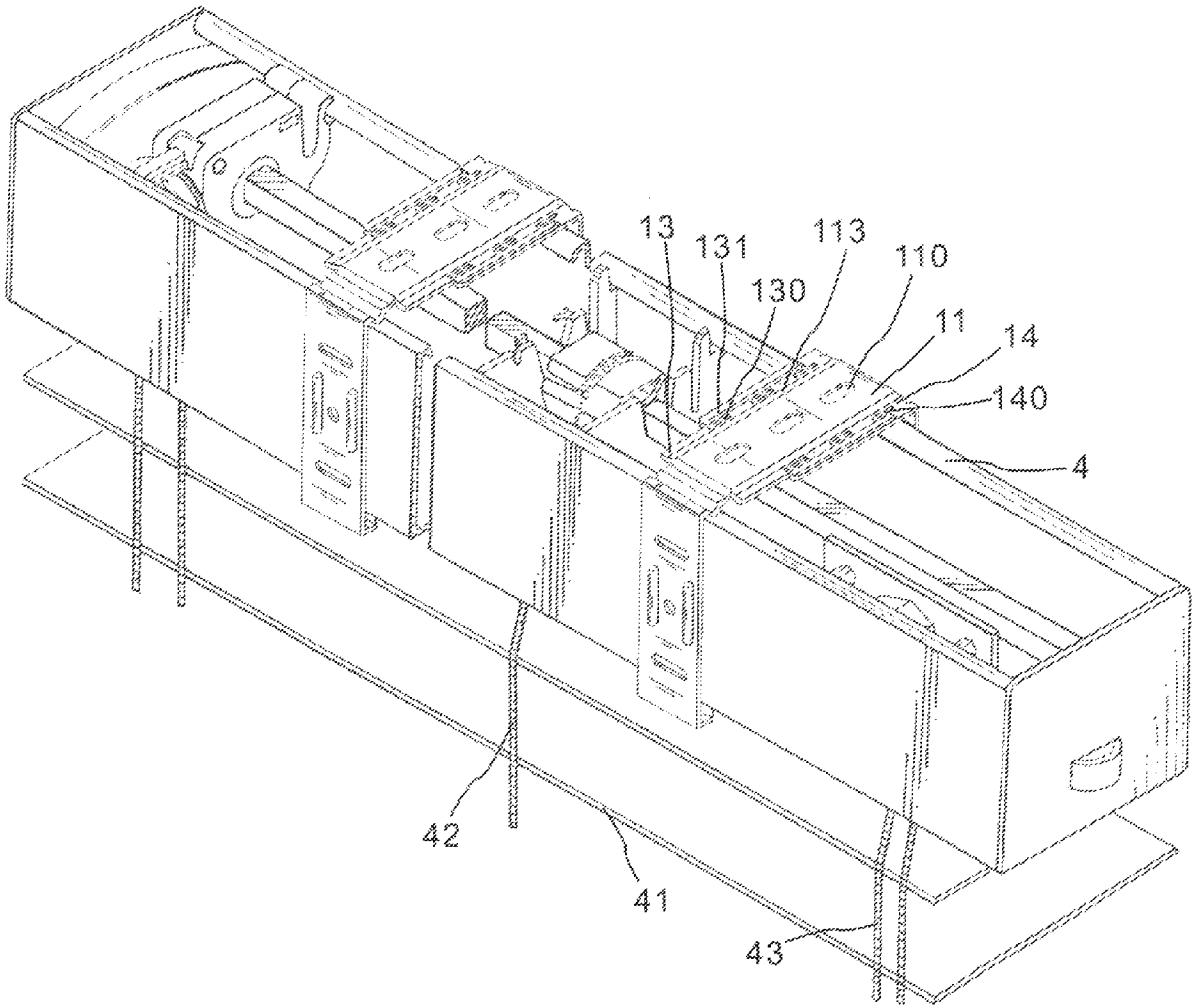
FIG. 6 is a perspective view showing the use of the present invention.
Figure 7:
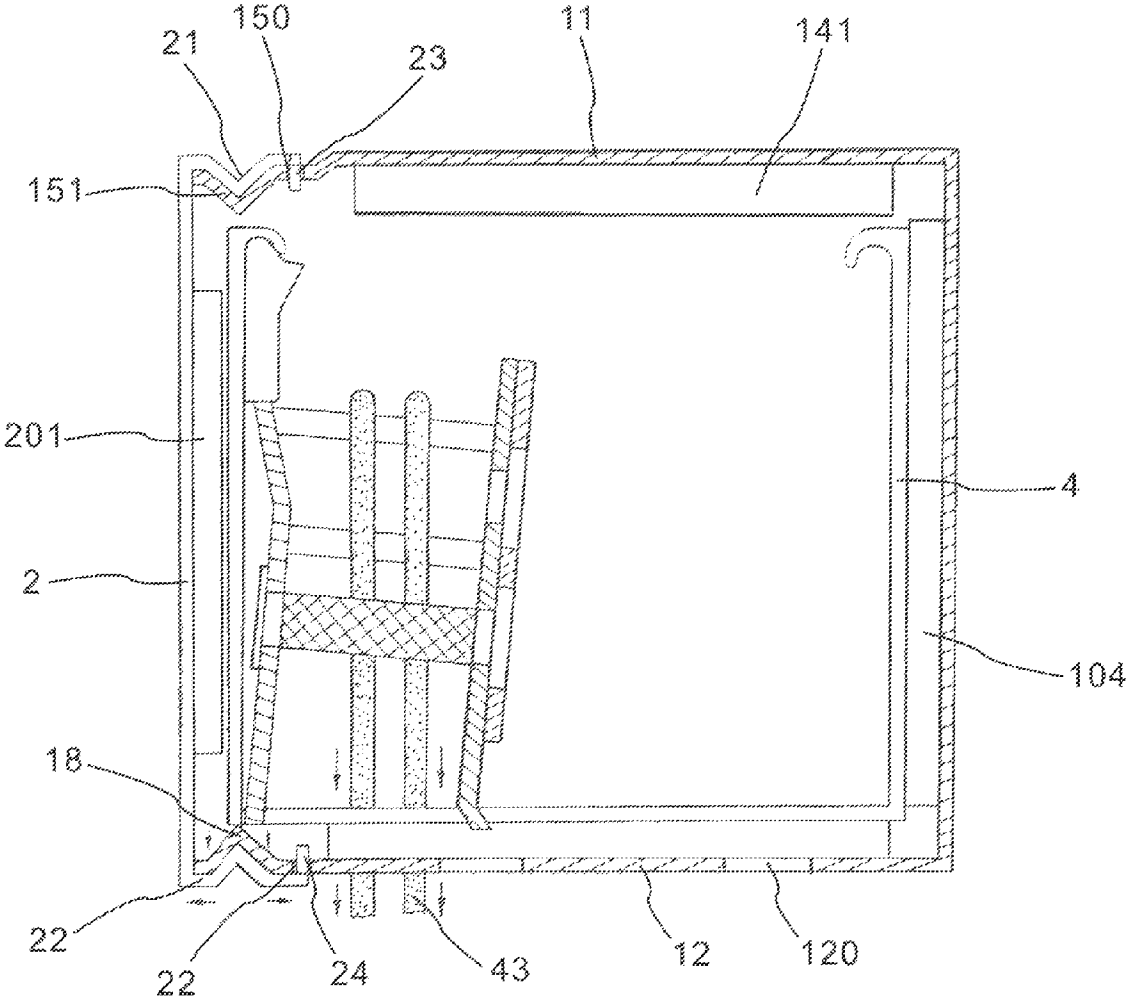
FIG. 7 is a sectional view showing the distribution of pulling force of the present invention.
Figure 9:
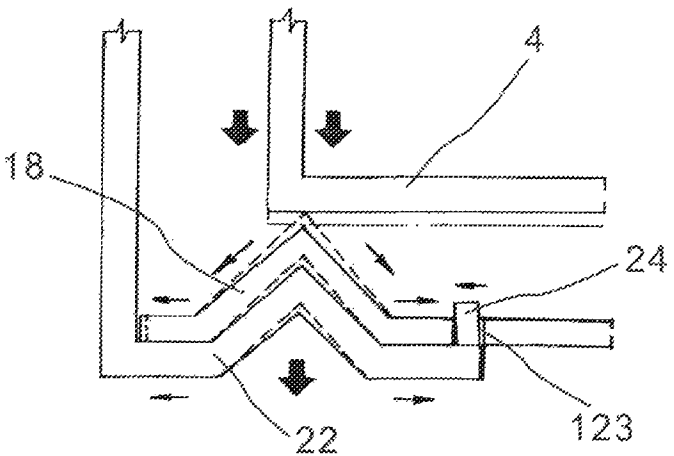
FIG. 9 is a view showing the engagement force of the present invention.
Figure 8:
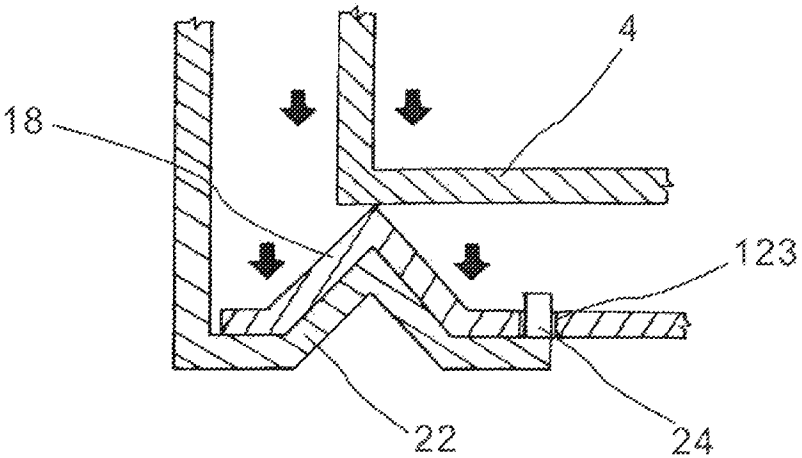
FIG. 8 is a sectional view showing the distribution of downward pressing force of the present invention.

Referring to FIGS. 6 and 7, after the blind rail 4 is fixed with the blind support, a downward pulling force can be applied to the control cord 43 to control opening/closing of the blind slats 41. At this time, the blind rail 4 will be pressed downward along with the control cord 43. Under such circumstance, the abutment section 22 of the engagement member 2 is pressed downward to normally push the key body 24 of the engagement member 2. Accordingly, after the key body 24 is located in the engagement hole 123, the key body 24 cannot be moved or extracted out of the engagement hole 123 (as shown in FIGS. 8 and 9). When it is desired to uninstall the blind rail 4, a lateral force is applied to the engagement member 2, whereby the key bodies 23, 24 of the engagement member 2 will be pushed and disengaged out of the engagement holes 150, 123 under the guide of the arcuate structure of the key bodies 23, 24. At this time, the engagement member 2 can be taken off to uninstall the blind rail 4.

Figure 10:
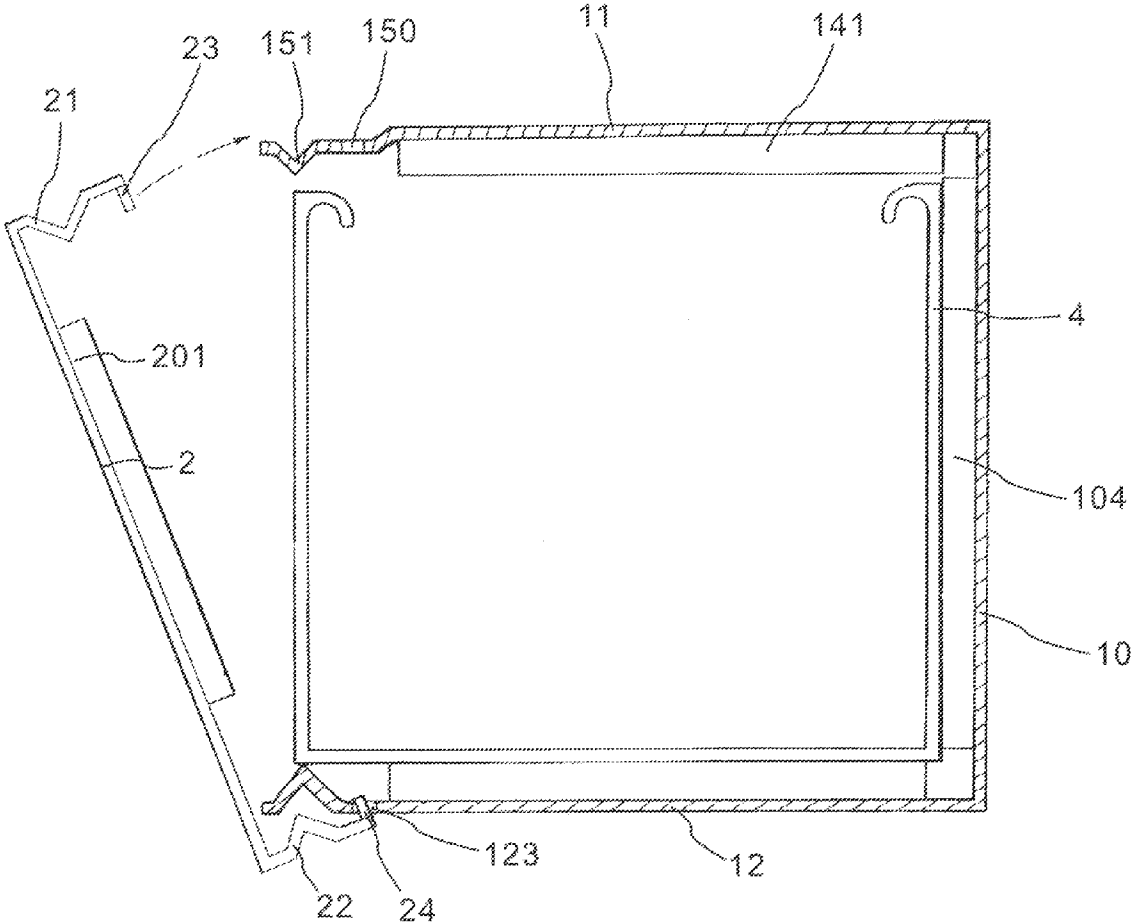
FIG. 10 is a sectional view showing another way to latch the engagement member with the main support body of the present invention.

FIG. 10 shows another way to install the engagement member 2 of the present invention. According to this embodiment, the lower key body 24 of the engagement member 2 is first engaged into the lower engagement hole 123 and then the upper abutment section 21 is directly pressed against the upper horizontal support board 11 to engage the upper key body 23 into the engagement hole 150 of the upper horizontal support board 11. The height of the engagement hole 150 is slightly lower than that of the upper horizontal support board 11. Therefore, the key body 23 can be easily directly engaged into the engagement hole 150 by means of pressing. In this case, the open side of the main support body 1 can be also blocked with the engagement member 2.

Figure 11:
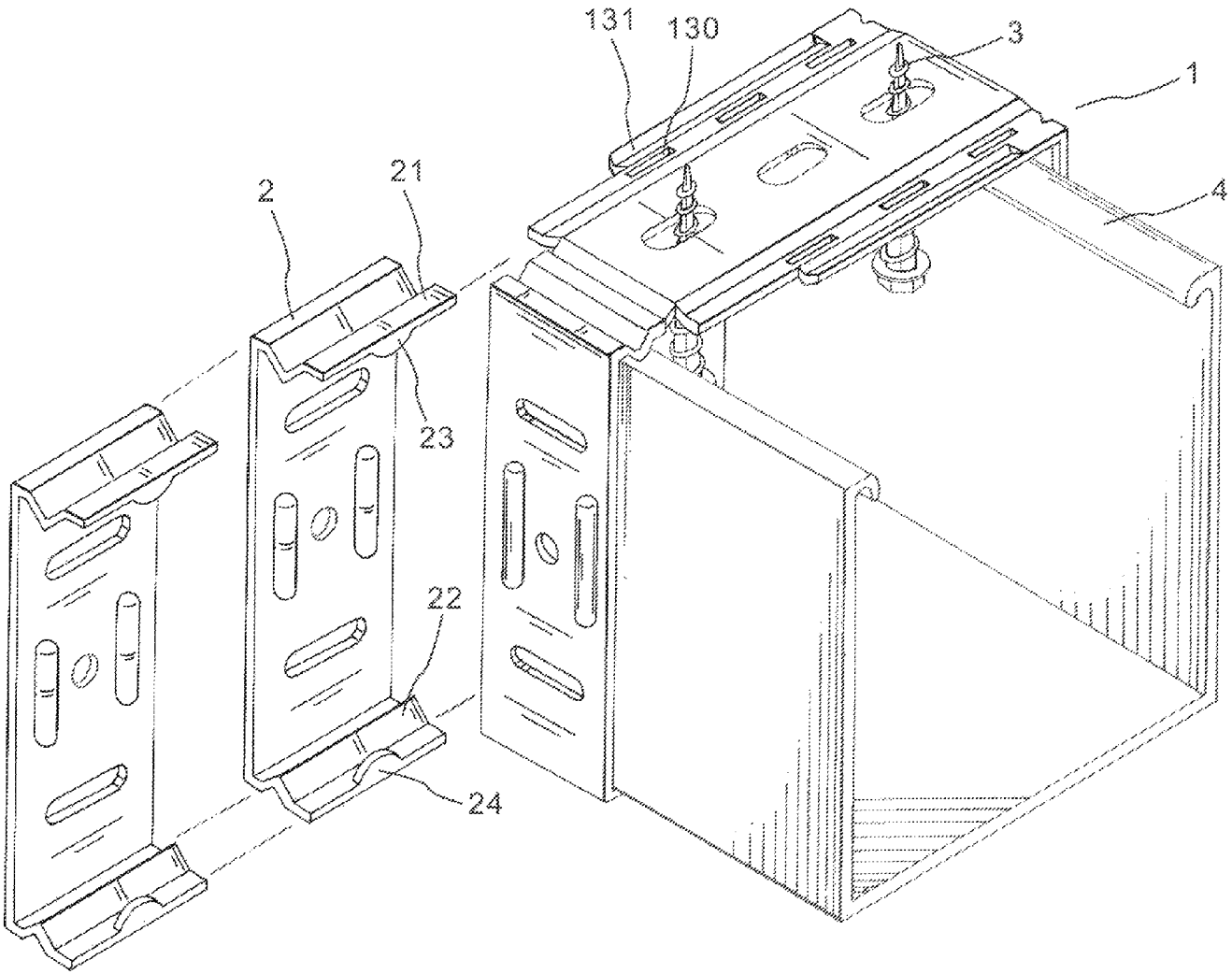
FIG. 11 is a perspective view showing another way to install the main support body of the present invention.
Figure 12:
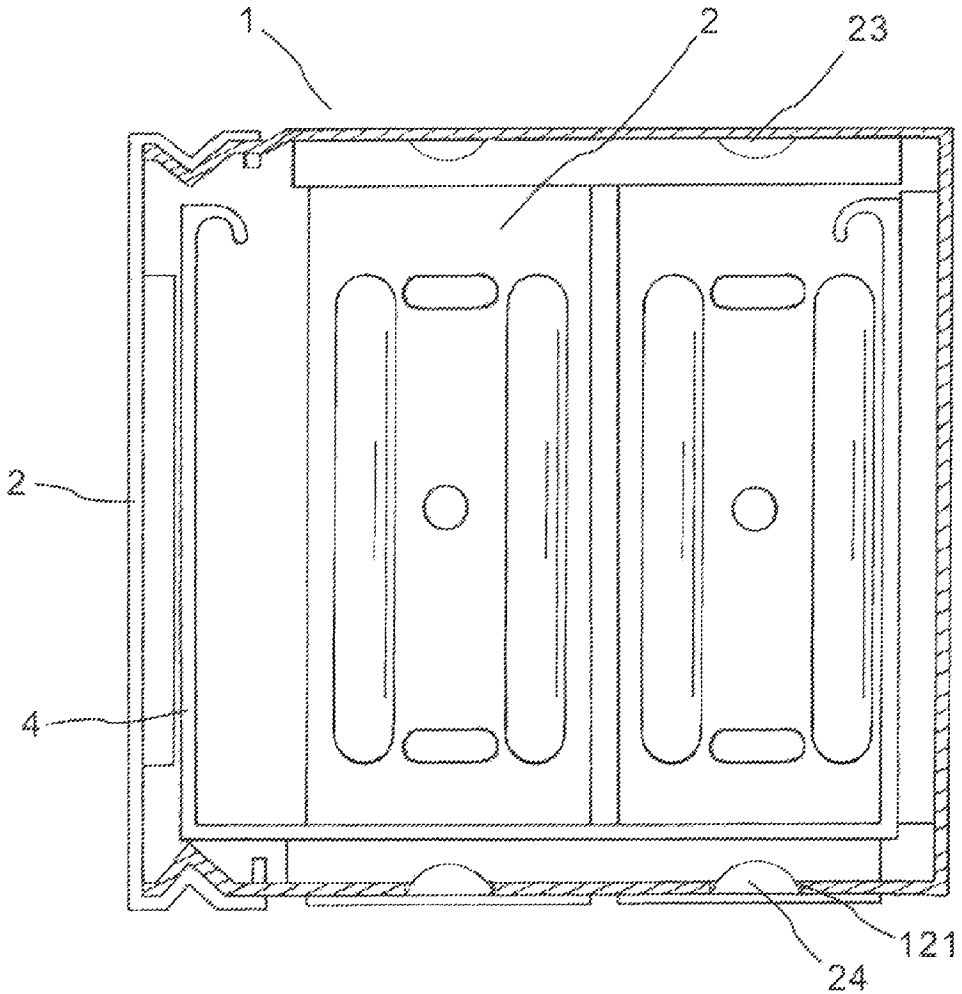
FIG. 12 is a plane view showing the installation of the present invention in another aspect.

Please now refer to FIG. 11. When the blind support of the present invention is mounted at an endmost section of the blind rail 4, two engagement members 2 can be laterally inserted to make the abutment sections 21, 22 slidably received in the slide channels 131, 16. Then the abutment sections 21, 22 are inward slid to make the key bodies 23, 24 of the abutment sections 21, 22 engaged into the engagement holes 121. Accordingly, the engagement members 2 can be fixedly connected with the main support body 1 to block the endmost opening of the blind rail 4 (as shown in FIG. 12).

Figure 13:
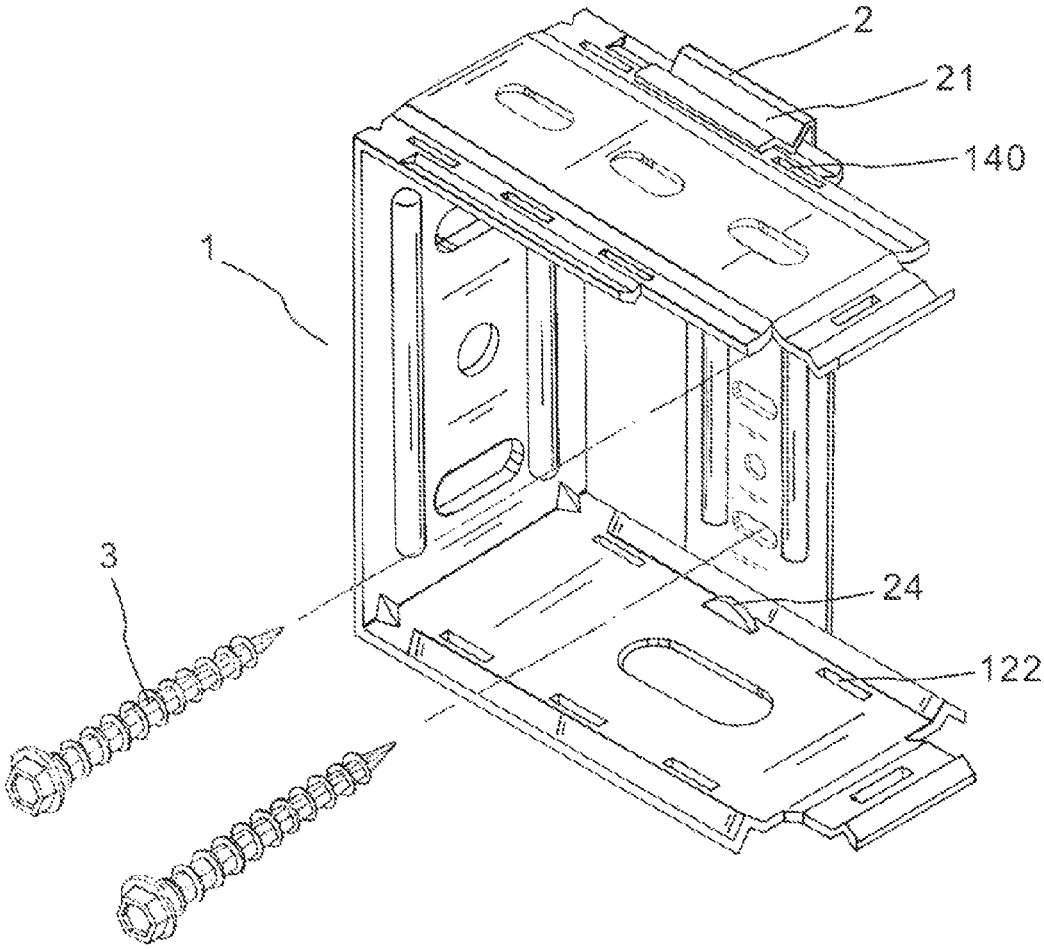
FIG. 13 is a perspective view showing still another way to install the present invention.
Figure 14:
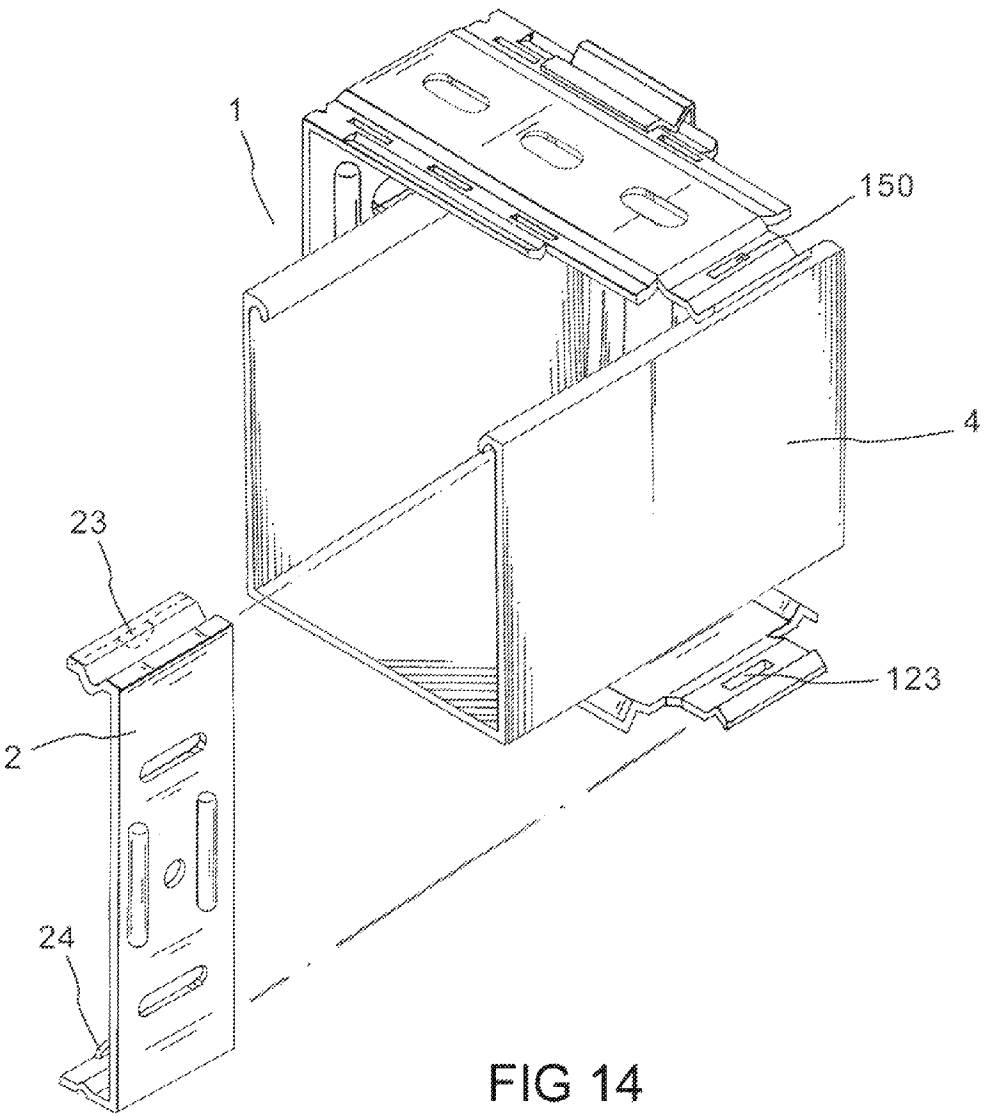
FIG. 14 is a perspective view showing the installation process of the present invention in another aspect.
Figure 15:
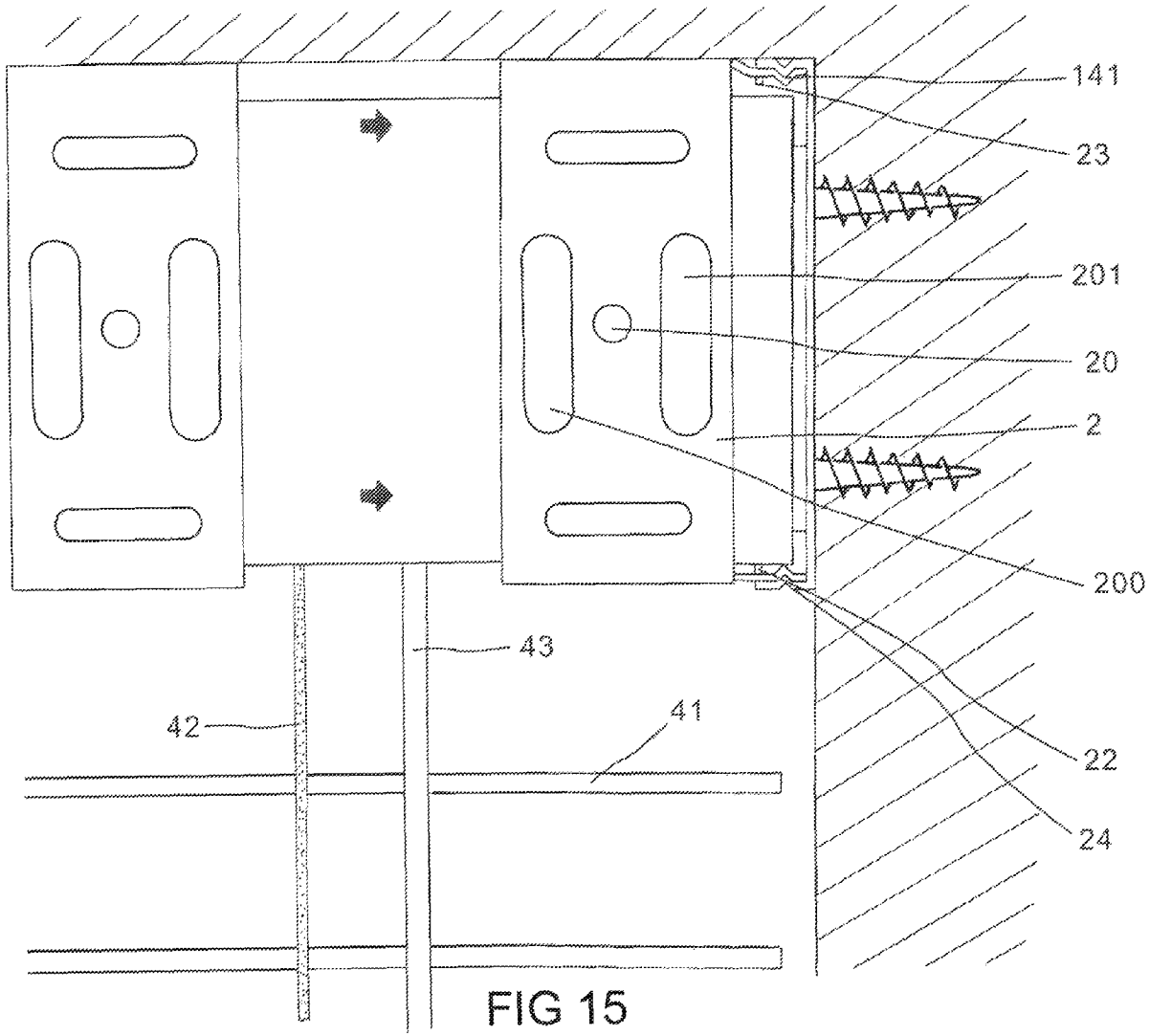
FIG. 15 is a sectional view showing that the installation of the present invention is completed in another aspect.

FIG. 13 shows another way to fix the engagement member 2 of the present invention. On the lateral side of the main support body 1, an engagement member 2 is laterally inserted to make the abutment sections 21, 22 slidably received in the slide channels 17, 141. Then the abutment sections 21, 22 are inward moved to a middle section to make the key bodies 23, 24 of the abutment sections 21, 22 engaged into the engagement holes 122, 140 as a fixing board of the endmost section of the blind rail 4. Long screws 3 are used to first fix the blind support on a wall face of one side of a window. Then the blind rail 4 is placed into the main support body 1 through the open side thereof (as shown in FIG. 14). Then the engagement member 2 is laterally inserted or directly pressed to make the key bodies 23, 24 of the engagement member 2 engaged into the engagement holes 123, 150. In this case, the engagement member 2 is securely connected with the main support body 1 to support the blind rail 4 (as shown in FIG. 15).

Figure 16:
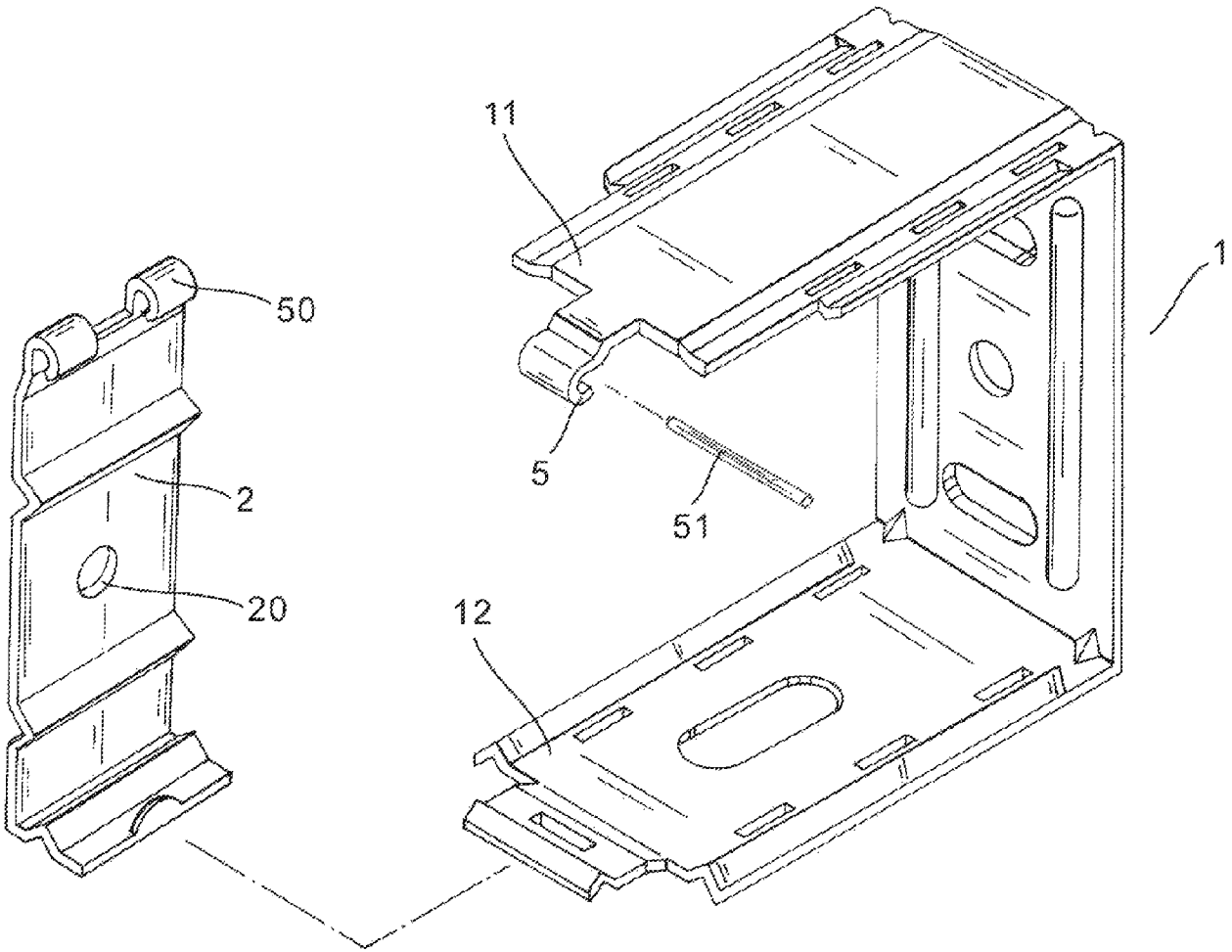
FIG. 16 is a perspective exploded view of another embodiment of the present invention.
Figure 17:
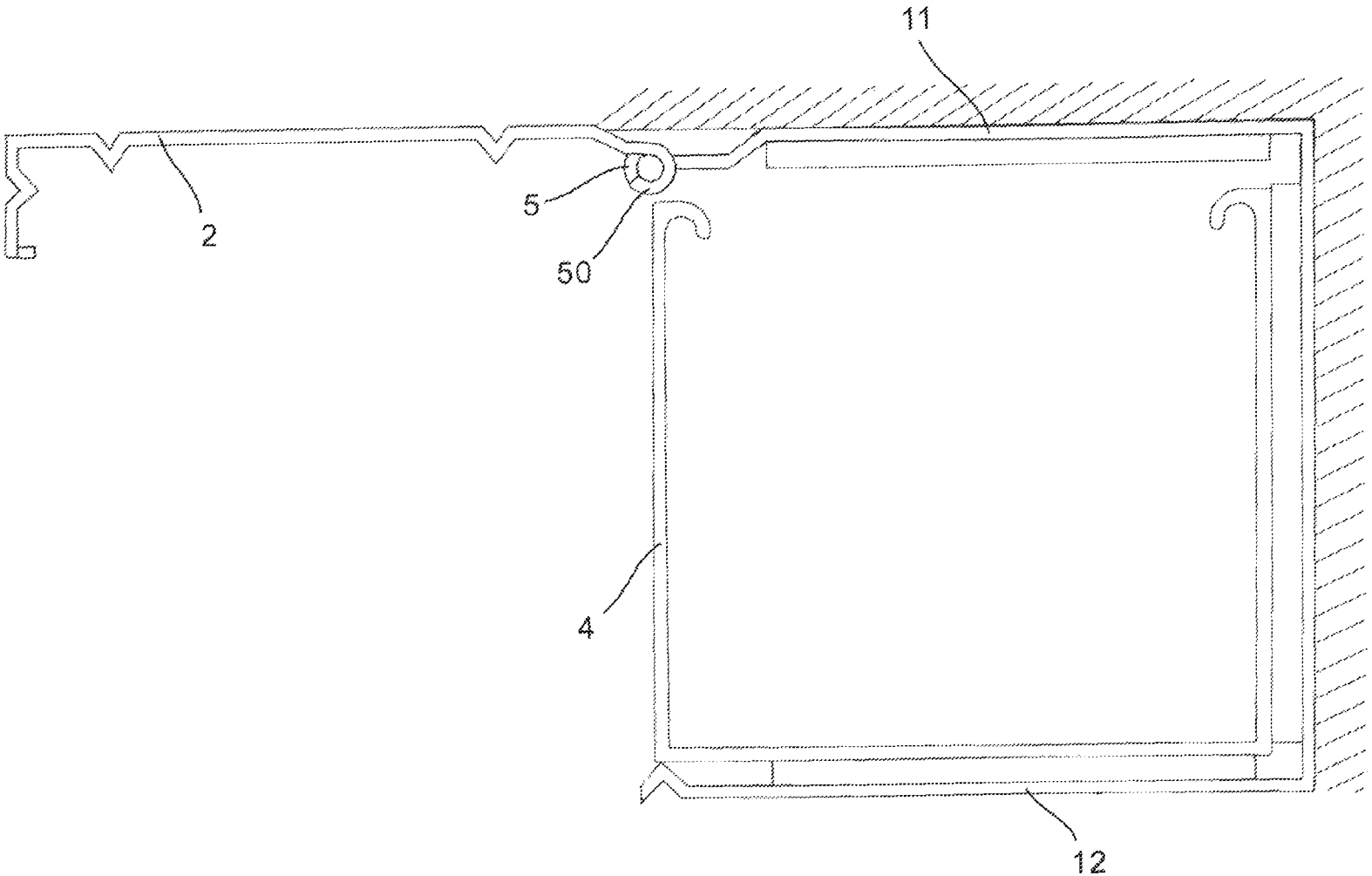
FIG. 17 is a plane view showing the operation of the other embodiment of the present invention.
Figure 18:
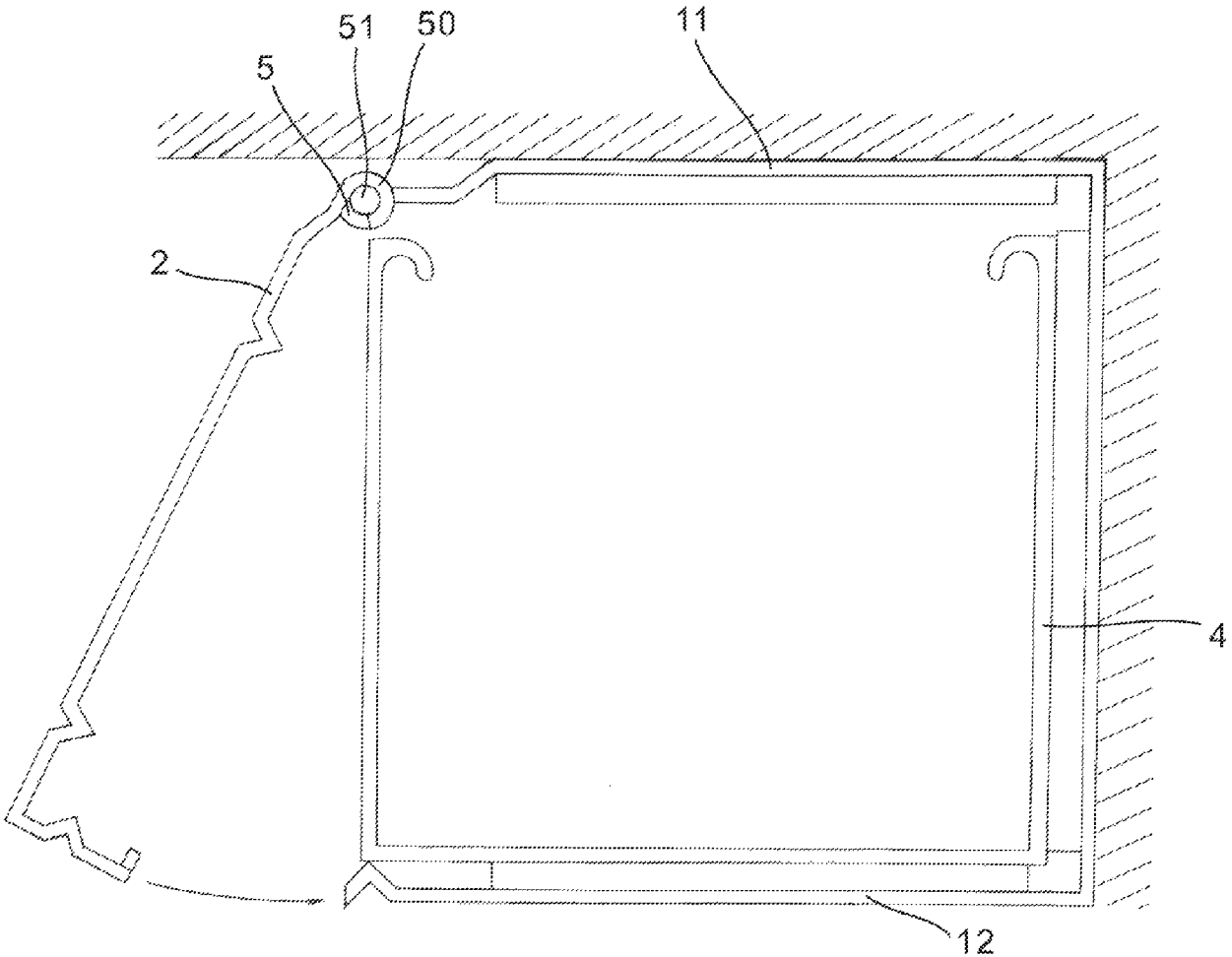
FIG. 18 is a plane view according to FIG. 17, showing the latching operation of the other embodiment of the present invention.
Figure 19:
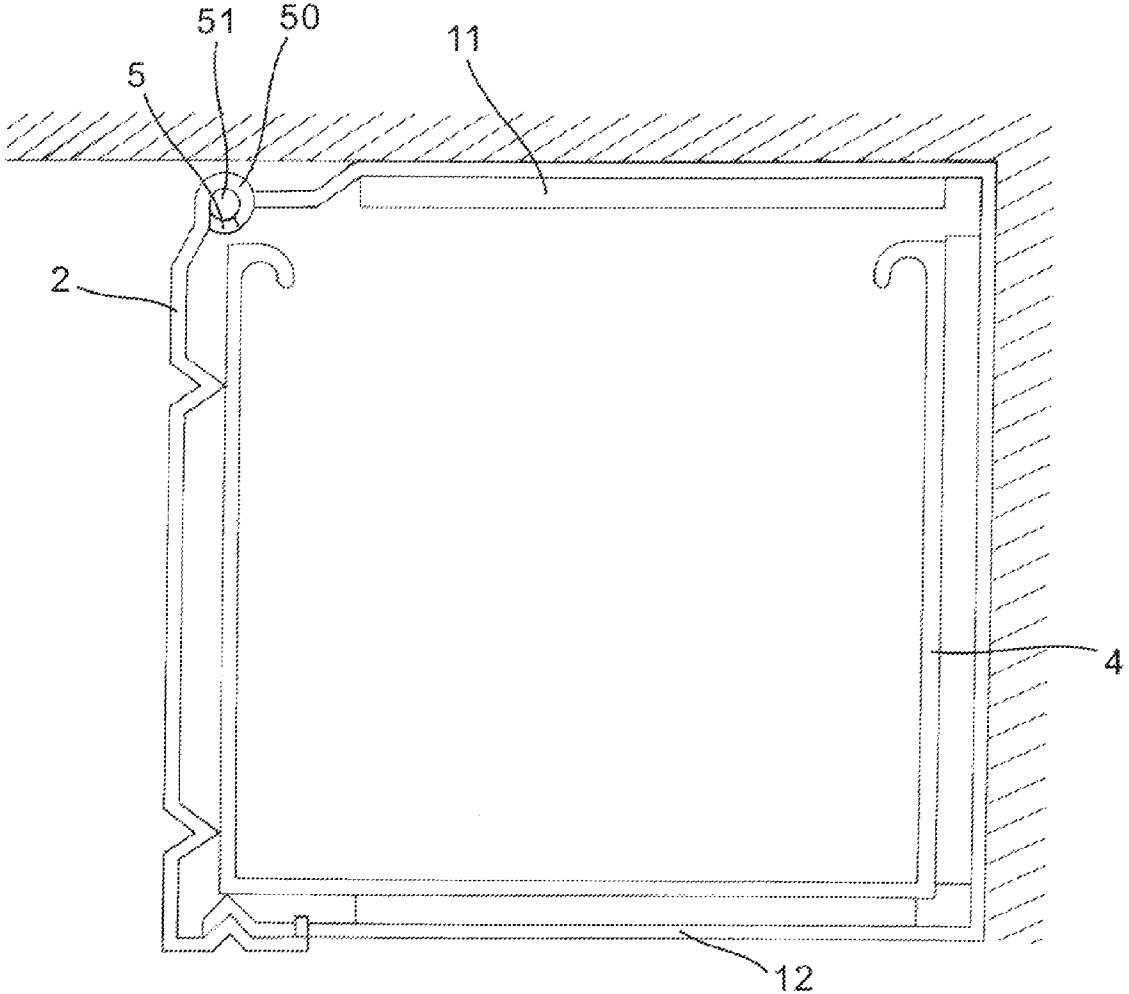
FIG. 19 is a plane view according to FIG. 17, showing that the latching operation is completed.

FIG. 16 shows another embodiment of the present invention. A C-shaped tubular section 5 forward extends from a front end of the upper horizontal support board 11 of the main support body 1 at a height lower than that of the horizontal support board 11. Correspondingly, a C-shaped tubular section 50 forward extends from an upper end of the engagement member 2. The C-shaped tubular sections 5, 50 are aligned with each other and a pivot shaft 51 is passed through the C-shaped tubular sections 5, 50 to form a hinge. Accordingly, the engagement member 2 can be rotated. The hinge is positioned at a height lower than that of the wall face so that the engagement member 2 can be rotated downward from a horizontal state toward the horizontal support board 12 of the main support body 1 and latched therewith out being obstructed (as shown in FIG. 15). In this case, the open side of the main support body 1 can be quickly blocked with the engagement member 2 to enclose and support the blind rail 4 (as shown in FIGS. 18 and 19).

Figure 20:
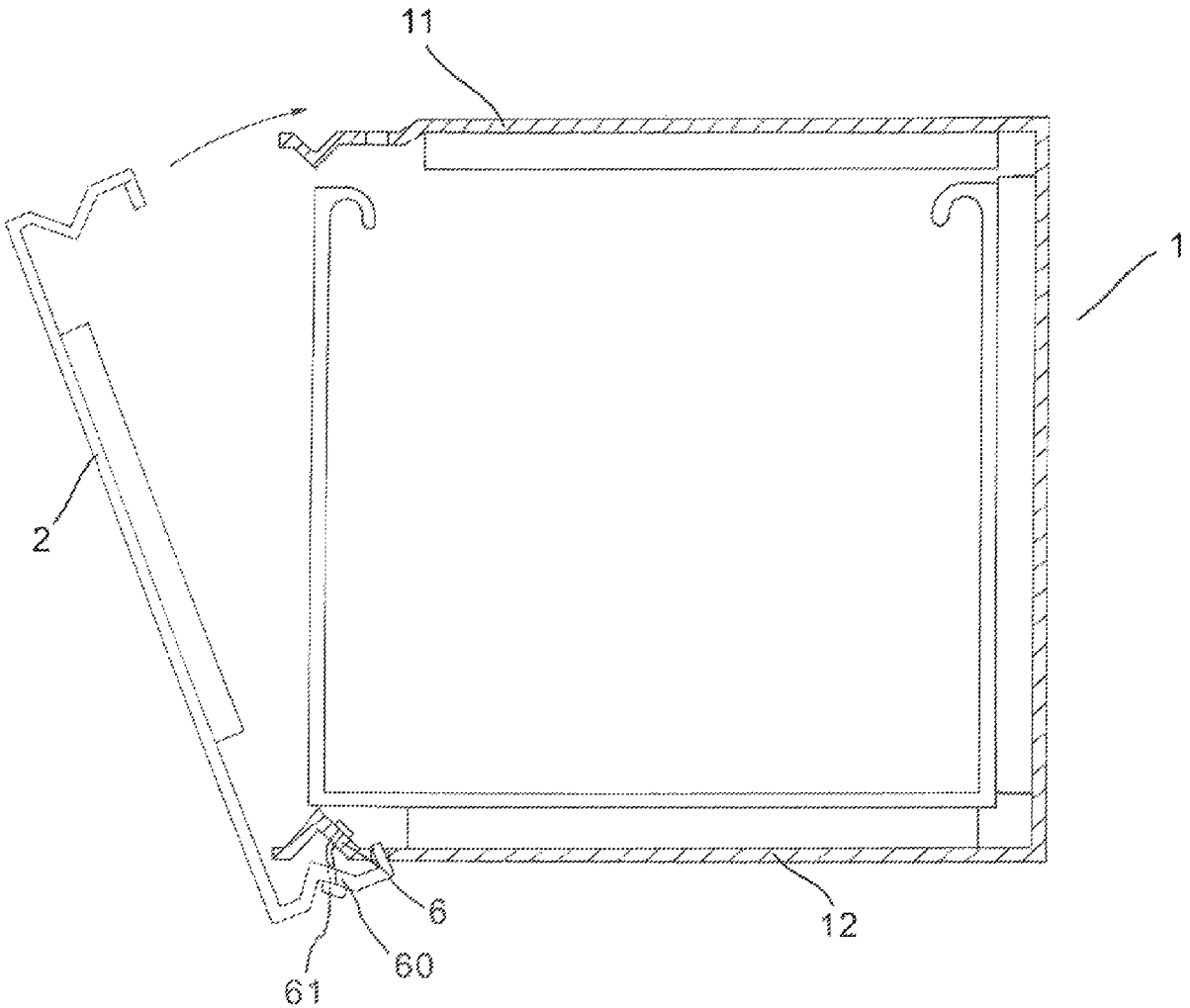
FIG. 20 is a sectional view of still another embodiment of the present invention, showing the installation thereof.

FIG. 20 shows still another embodiment of the present invention. Two corresponding through holes 6, 60 are formed in the slide channels of the horizontal support board 12 of the main support body 1 and the engagement member 2. A soft connection rod 61 is passed through the through holes 6, 60 to connect the horizontal support board 12 and the engagement member 2. Accordingly, the engagement member 2 can be rotated toward the horizontal support board 12 of the main support body 1 and directly latched therewith to block the open side of the main support body 1 and enclose and support the blind rail (as shown in FIG. 21).

Figure 21:
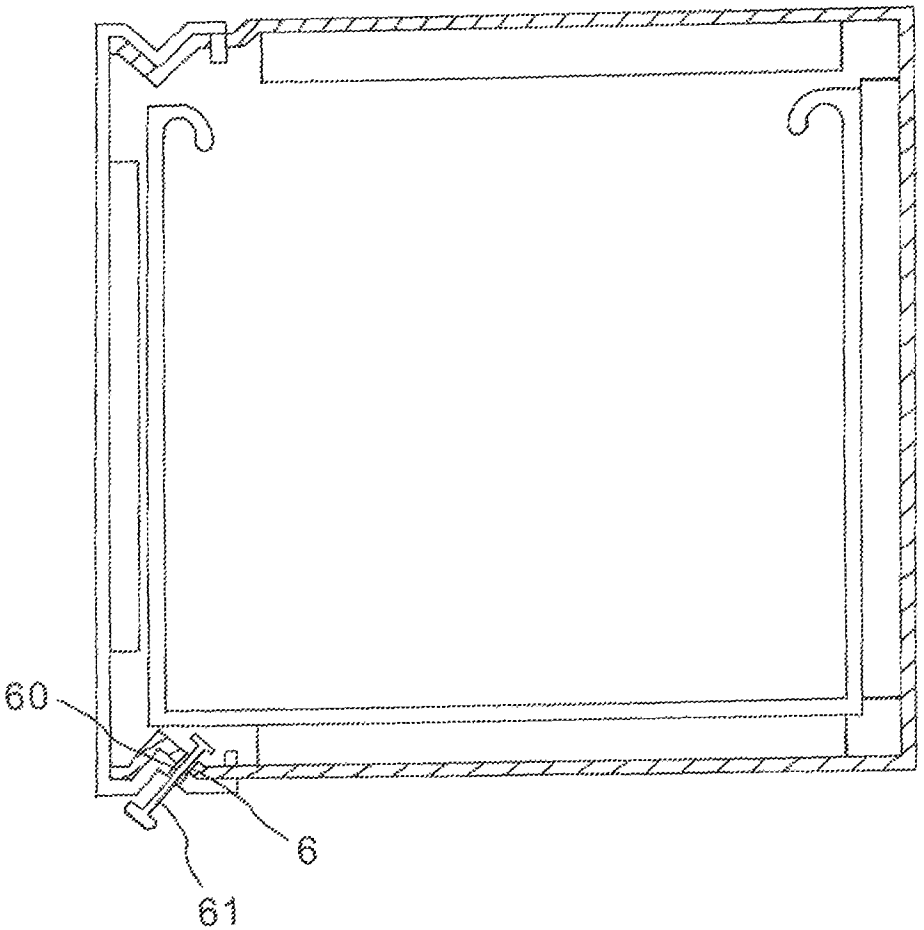
FIG. 21 is a sectional assembled view according to FIG. 20.
Figure 22:
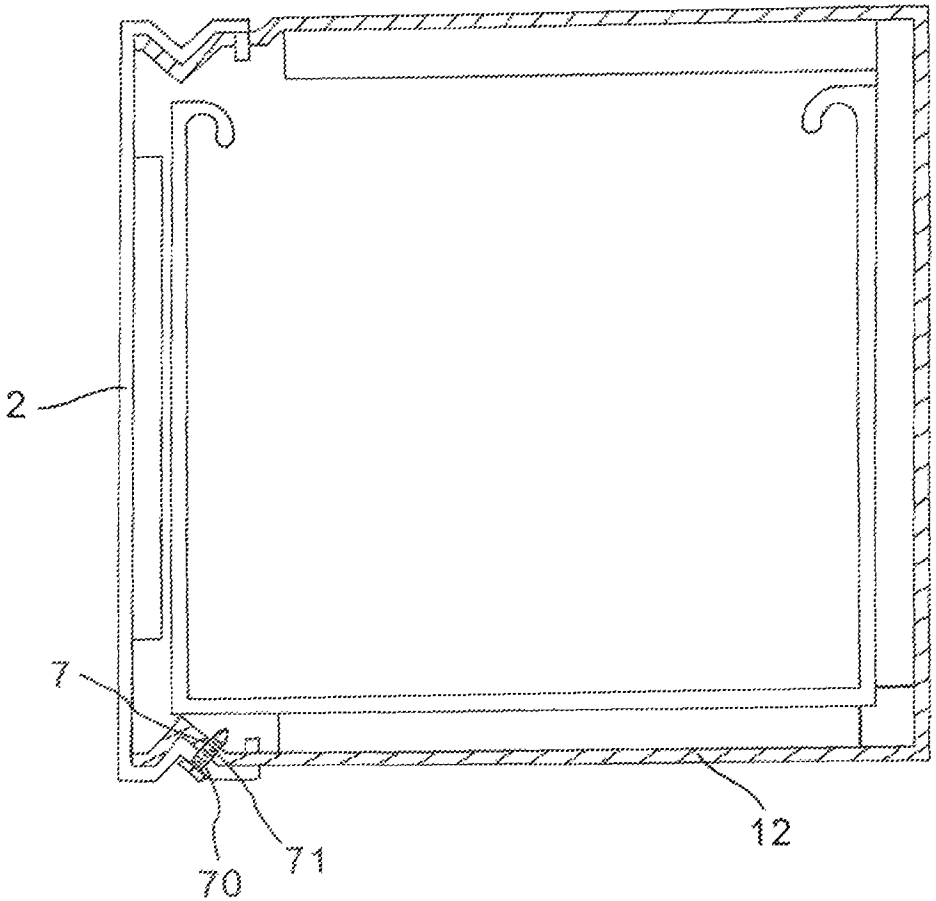
FIG. 22 is a sectional assembled view of still another embodiment of the present invention.
Figure 23:
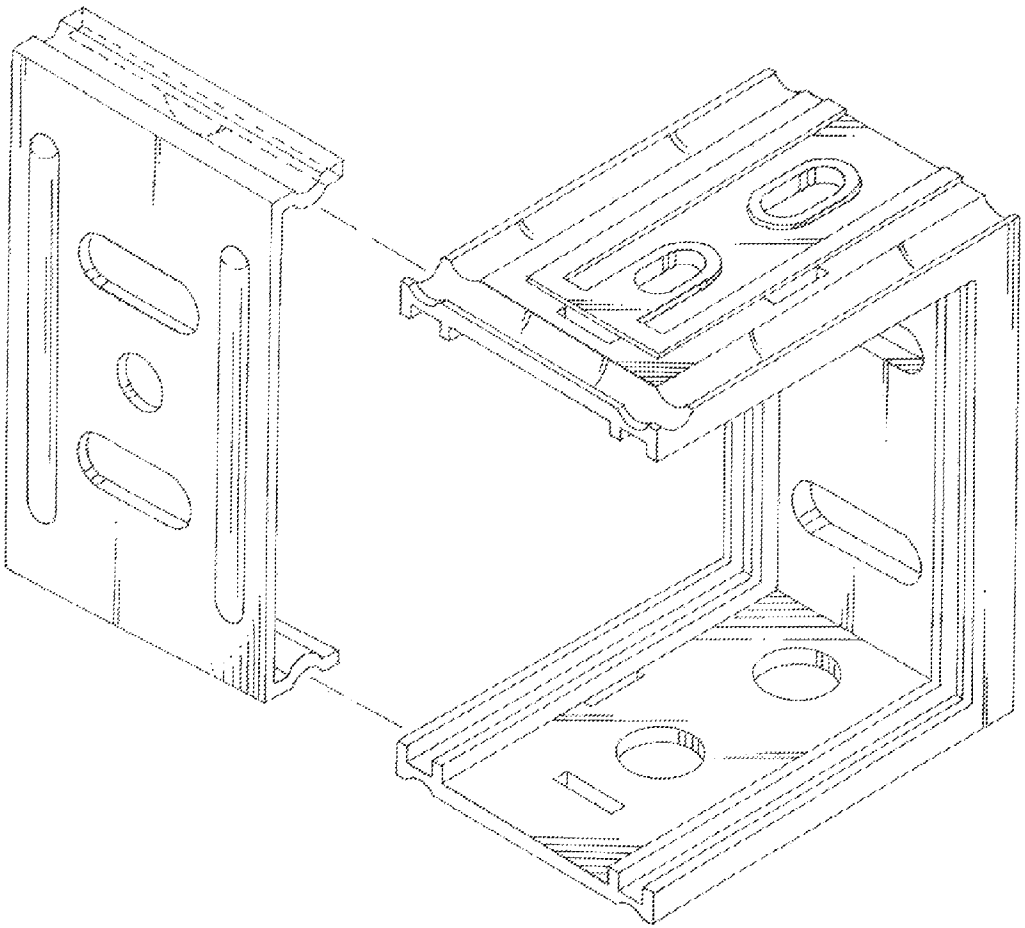
FIG. 23 is a perspective view showing that the present invention is made of plastic material.

FIG. 21 shows still another embodiment of the present invention. Two corresponding threaded holes 7, 70 are formed in the slide channels of the horizontal support board 12 of the main support body 1 and the engagement member 2. A threaded rod 71 is screwed through the threaded holes 7, 70 to connect the horizontal support board 12 and the engagement member 2. FIG. 23 is a perspective view showing that the present invention is made of plastic material by means of injection molding.

The above embodiments are only used to illustrate the present invention, not intended to limit the scope thereof. Many modifications of the above embodiments can be made without departing from the spirit of the present invention.

What is claimed is:

1. A blind support for installation of a blind rail, the blind support comprising:

a main support body having two horizontal support boards and a vertical support board connected between the two horizontal support boards to form a support body with an open side, a tubular section forward extending from a front end of an upper horizontal support board of the main support body at a height slightly lower than that of the horizontal support board;

several slide channel structures each having a recessed channel body, the slide channel structures outward extending from outer edges of the two horizontal support boards of the main support body;

an engagement member in the form of a vertical board body, an abutment section forward extending from an upper end of the vertical board body, the abutment section being slidably receivable in the slide channels, a key body downward projecting from front end of the abutment section, a tubular section forward extending from an upper end of the vertical board body;

a pivot shaft passed through the tubular section of the horizontal support board of the main support body and the tubular section of the vertical board body of the engagement member; and several engagement holes respectively formed on the upper and lower horizontal support boards of the main support body in parallel to and in alignment with each other, the key bodies of the engagement member being engageable in the engagement holes.

2. The blind support for installation of the blind rail as claimed in claim 1, wherein the tubular sections are disposed at a front end of the lower horizontal support board of the main support body and a lower end of the vertical board body of the engagement member.

* * * * *